US005398434A

United States Patent [19]

Biancalani

[11] Patent Number: 5,398,434

[45] Date of Patent: Mar. 21, 1995

[54] STEAM IRON WITH EXTRACTABLE WATER CONTAINER AND DEMINERALIZING CARTRIDGE

[76] Inventor: Mauro Biancalani, Via Ida Baccini No.11, 50141 Firenze, Italy

[21] Appl. No.: 6,642

[22] Filed: Jan. 21, 1993

[30] Foreign Application Priority Data

Jan. 21, 1992 [IT] Italy ..... FI92A0013

[51] Int. Cl.[6] ..... D06F 75/18

[52] U.S. Cl. ..... 38/77.3; 38/77.8

[58] Field of Search ..... 38/77.1, 77.3, 77.8, 38/77.82, 77.5, 77.6; 210/94, 282

[56] References Cited

U.S. PATENT DOCUMENTS

| | | | |
|---|---|---|---|
| 3,949,499 | 4/1976 | Schaeffer | 38/77.3 |
| 4,565,019 | 1/1986 | Cavalli | 38/77.6 |
| 4,656,763 | 4/1987 | Kawasaki et al. | 38/77.3 X |
| 4,893,422 | 1/1990 | Mahlich et al. | 210/94 X |
| 4,939,856 | 7/1990 | Czerner | 38/77.5 X |
| 4,969,393 | 11/1990 | Chr. Mahlick et al. | 38/77.8 X |
| 5,063,697 | 11/1991 | Valente et al. | 38/77.8 X |
| 5,138,778 | 8/1992 | Brandolini | 38/77.3 X |

FOREIGN PATENT DOCUMENTS

| | | | |
|---|---|---|---|
| 0322383 | 6/1989 | European Pat. Off. . | |
| 0402256A1 | 12/1990 | European Pat. Off. . | |
| 0459559A1 | 12/1991 | European Pat. Off. . | |
| 2653455 | 10/1989 | France . | |
| 2632331 | 12/1989 | France | 38/77.8 |
| 3033964 | 4/1982 | Germany | 38/77.8 |
| 0171594 | 9/1984 | Japan | 38/77.3 |
| 2033000 | 2/1987 | Japan | 38/77.3 |
| 3171600 | 7/1988 | Japan | 38/77.3 |
| 58-29498 | 2/1993 | Japan . | |

*Primary Examiner*—Clifford D. Crowder
*Assistant Examiner*—Ismael Izaguirre
*Attorney, Agent, or Firm*—McGlew and Tuttle

[57] ABSTRACT

The steam iron comprises a container (27) which is inserted into a seating (15) open at the rear, so as to open a hole (17A) in a wall (17) of the tank (19) and supply water to the tank itself which delivers said water to the vaporization chamber (5); the container acts as a water metering device, reservoir and container for decalcifying agents. (FIG. 1)

9 Claims, 5 Drawing Sheets

STEAM IRON WITH EXTRACTABLE WATER CONTAINER AND DEMINERALIZING CARTRIDGE

FIELD AND BACKGROUND OF THE INVENTION

Steam irons with a water measuring device for filling the reservoir are known, along with steam irons which have a completely removable front section incorporating pumps, valves, plugs and various devices. Both solutions are costly, complicated and easily damaged.

Steam irons also require the use of distilled water to prevent the formation of lime in the plate.

SUMMARY AND OBJECTS OF THE INVENTION

The present invention solves these problems and relates to a steam iron which is extremely simple and very low-cost and which ensures: greater safety, since filling and emptying of the steam iron are performed away from the electrical parts; greater reliability, owing to its extreme simplicity and the direct application to the evaporation chamber without the need for valves, ducts or the like, thus reducing the possibility of failure or breakage; considerably lower production costs.

The steam iron in question is of the type comprising a plate, heating means for said plate, said plate and said means cooperating to form a vaporization chamber; a water tank is located above said vaporization chamber and supplies the water to said vaporization chamber via a calibrated passage adjustable by means of a shaped stem. According to the invention, the steam iron in question also comprises: a seating extending from the rear end of the iron, with an end wall which separates said seating from said tank, provided with a communication hole; a container designed to be inserted into and extracted from said seating, with a tubular filling mouth designed to penetrate into said hole so as to establish communication between said tank and said container; an obturator inside said tank biased elastically so as to close off said hole and capable of being moved away from said hole by the tubular mouth upon insertion of the container into said seating.

BRIEF DESCRIPTION OF THE DRAWINGS

The invention will be understood better with reference to the description and accompanying drawing which shows a non-limiting embodiment of the invention itself. In this drawing.

DETAILED DESCRIPTION OF THE PREFERRED EMBODIMENT

Figure 1:
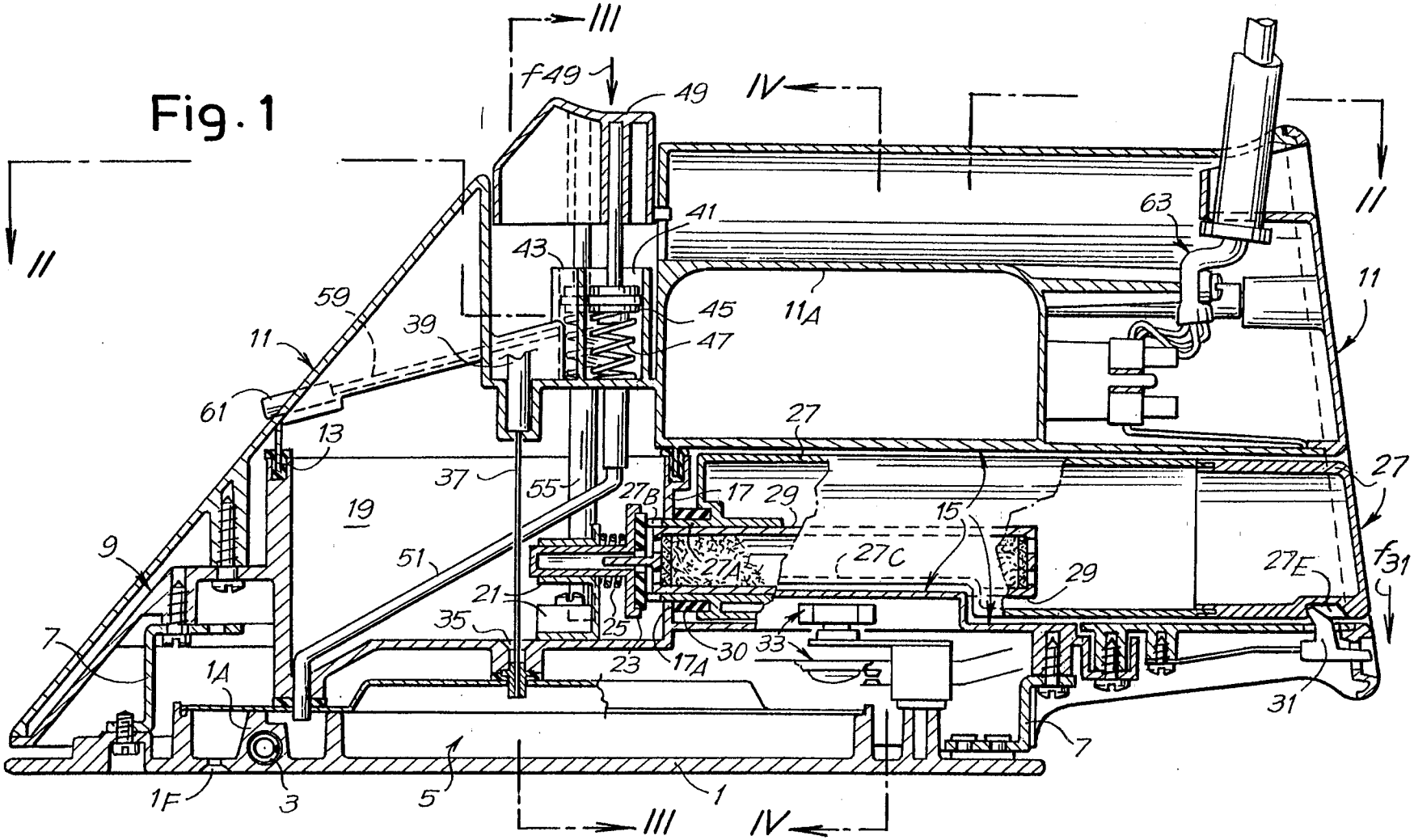
FIG. 1 shows the iron with the container inserted, in longitudinal section.
Figure 2:
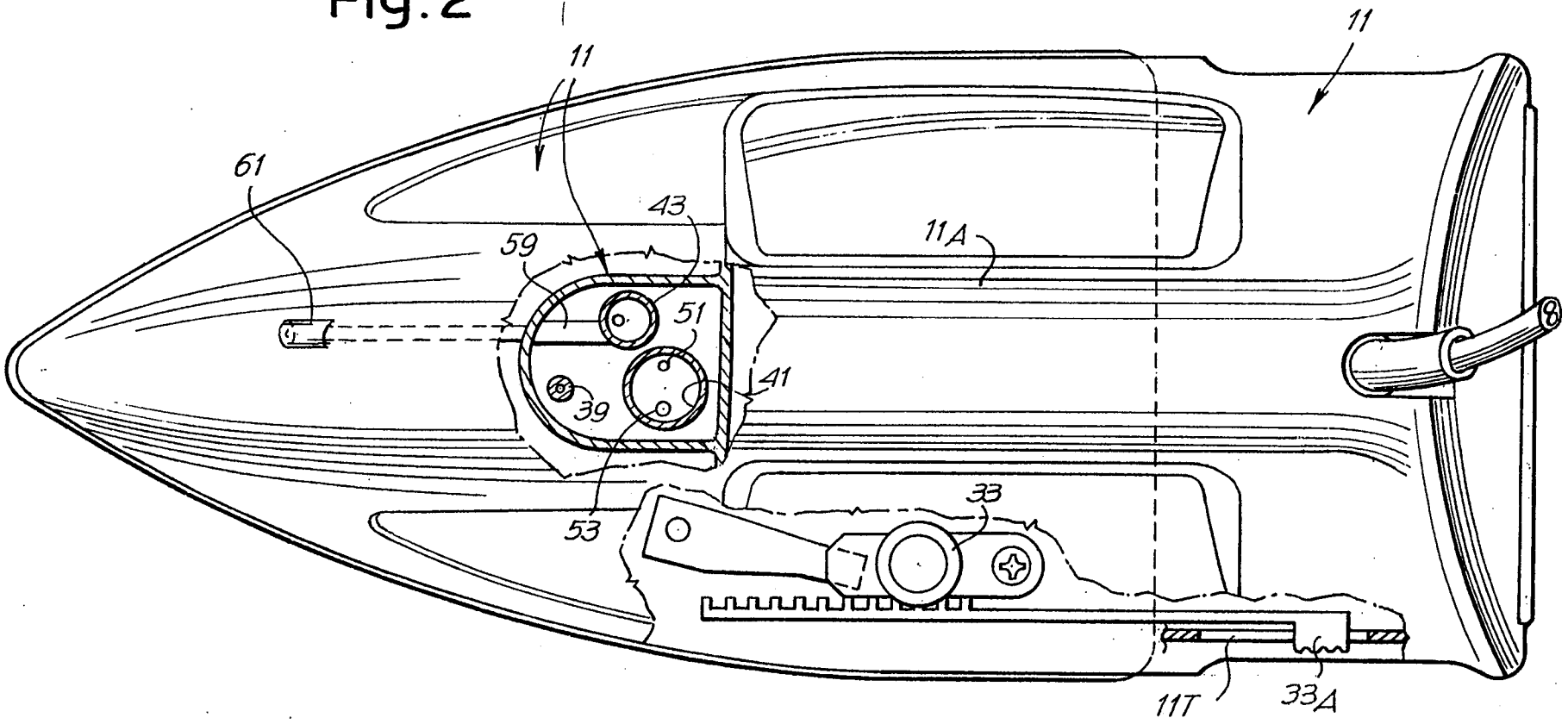
FIG. 2 shows a view and partial section along II—II of FIG. 1, in very schematic form.
Figure 3:
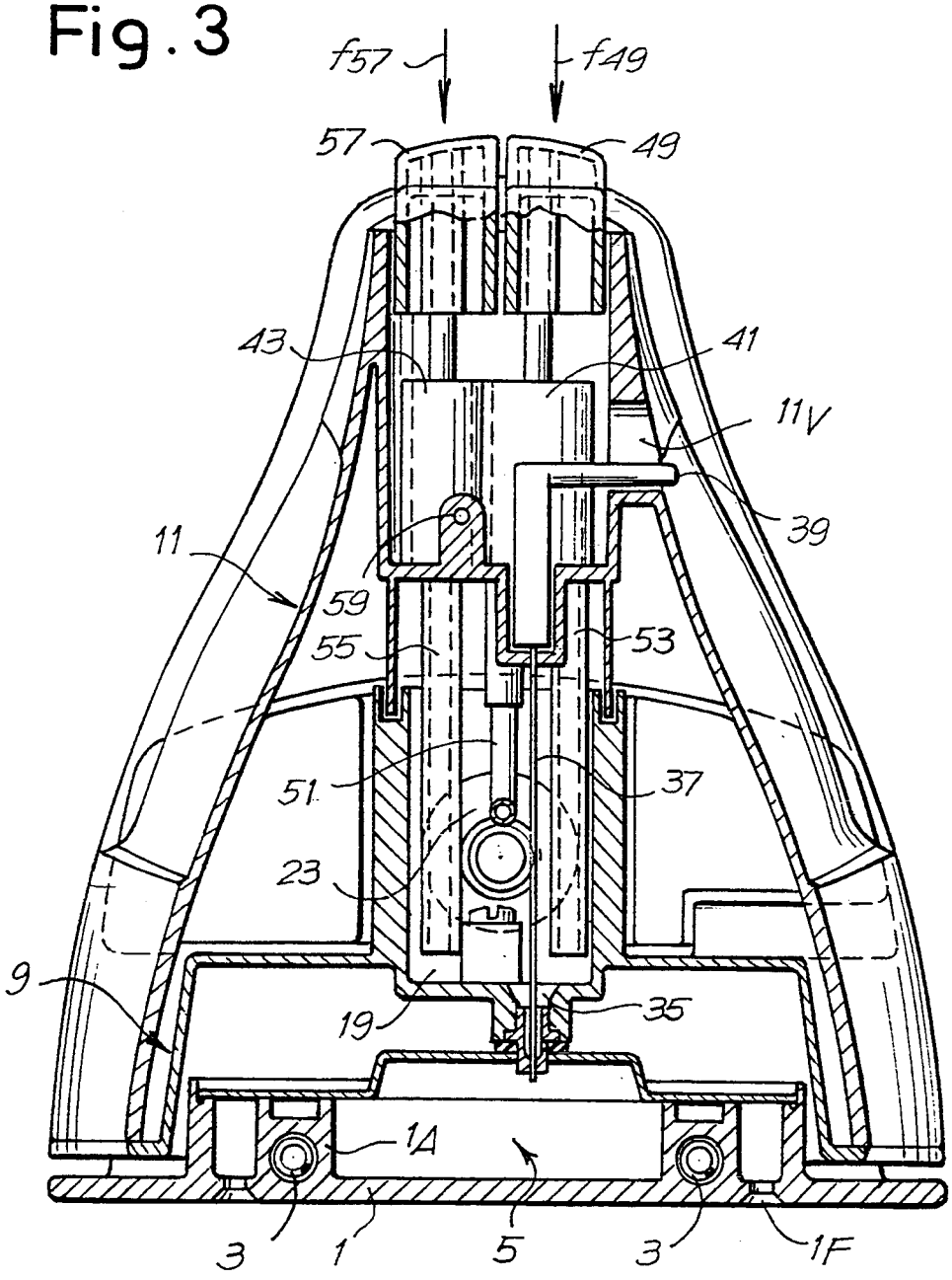
FIGS. 3 and 4 show two cross-sections along III—III and IV—IV of FIG. 1.
Figure 4:
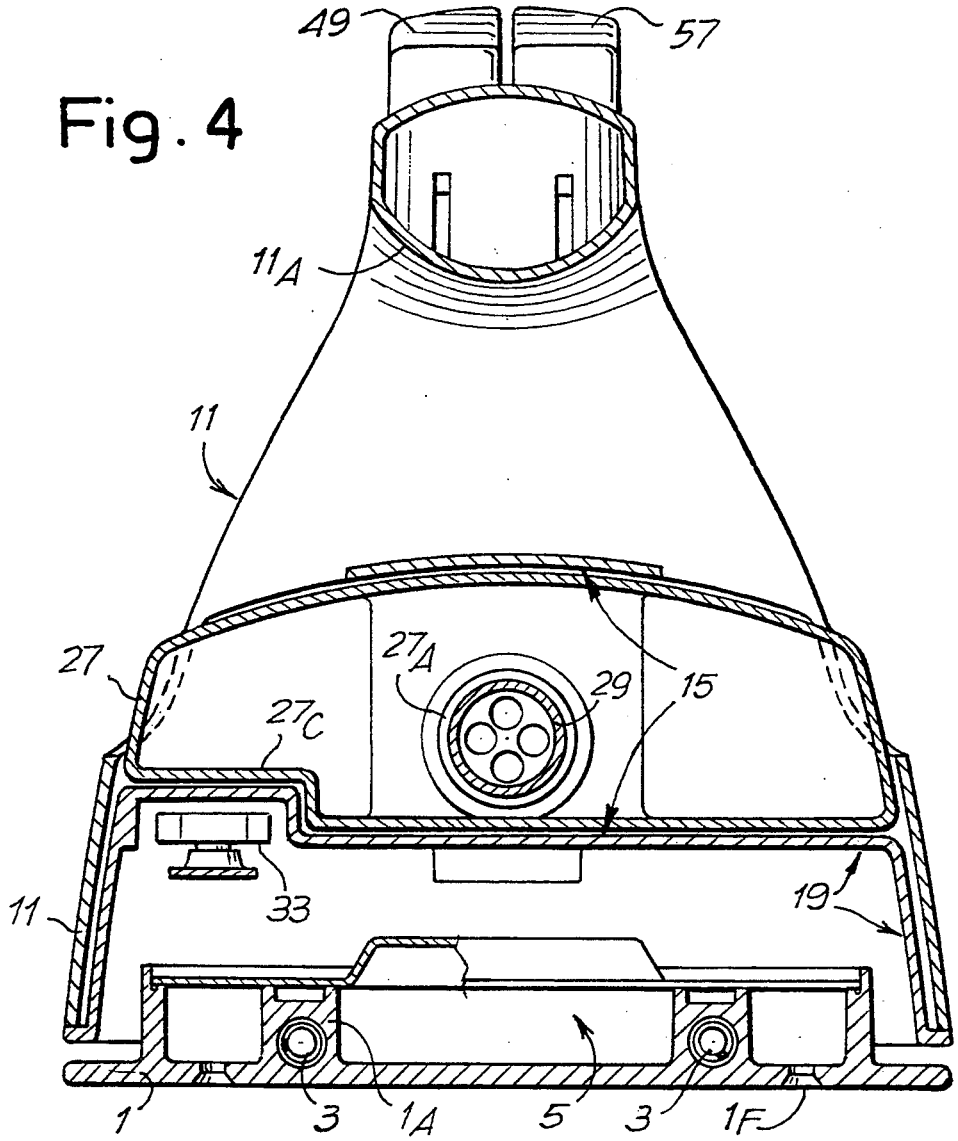

In the drawing, 1 denotes the plate of the iron, which is heated by means of a resistor 3 extending in the approximate shape of a horse shoe and incorporated in the shoulder 1A which partially surrounds the evaporation chamber 5. The plate 5 is fixed, by means of brackets 7, to an overlying casing 9 which is suitably shaped. On top of this casing 9 there is further located a shell 11 which is combined with the casing and is shaped so as to form, among other things, the handle 11A of the iron. 13 denotes a seal between the casing 9 and the shell 11.

In the rear part of the iron, the casing 9 and the shell 11 define a seating 15 open at the rear and extending parallel to the plate 1; the seating 15 defined by an end wall 17 provided with a hole 17A. The casing 9 and the shell 11 define a tank 19, which is partially bounded by said wall 17. Inside the tank 19 a bracket 21 forms a sliding seat for an obturator 23 which is biased by a spring 25 so as to close the opening 17A of the wall 17 bounding the tank 19.

A container 27 forming a measuring device for replenishing the iron with water may be slidably inserted into the seating 15. This container 27 is shaped so as to occupy the seating 15 and has a tubular mouth 27A capable of penetrating through the hole 17A when the container 27 is inserted fully into the seating 15. The tubular mouth 27A may receive a cartridge 29 forming a filter for demineralizing the water which can be delivered from the container 27 into the tank 19. The tubular mouth 27A has—on its externally protruding edge—recesses 27B capable of ensuring communication between the container 27 and the tank 19 when this container 27 has been inserted and, via the mouth 27A, lifts the obturator 23 against the action of the spring 26. An annular seal 30 surrounds the protruding part of the tubular mouth 27A so as to rest against the wall 17 when the container 27 is inserted.

When the container 27 is extracted, the obturator 23 is able to rest against the wall 17 so as to close the hole 17A, biased by the spring 26. When completely inserted, the container is held in position by an elastic tooth 31, which may be depressed manually in the direction of the arrow f31 in order to extract the container. The container 27 has a part 27C shaped so as to accommodate the dimensions of a thermostat 33 arranged on one side of the iron and adjustable by means of displacement of an operating member 33A along a slit 9T in the casing 9. The thermostat 33 controls the temperature of the plate 1 and the power supply of the resistor 3.

In the bottom of the tank 19 there is formed a calibrated passage 35 inside which the position of a shaped stem 37 can be axially adjusted, said stem being integral with an operating member 39 projecting from a slit 11V in the shell 11, so as to regulate the movement of water under gravity from the tank 19 to the vaporization chamber 5 heated by the resistor 3.

Inside the shell, alongside the regulating member 39, there are formed two cylinders 41 and 43 for two small pumps, the pistons of which are biased by springs for lifting and sucking and by pushbuttons for lowering and delivery of quantities of water drawn from the tank 19. The drawing shows the piston 45 of the cylinder 41, the spring 47 and the pushbutton 49 which can be operated in the direction of the arrow f49 against the action of the spring 47, so as to force water into a duct 51 which leads into the vaporization chamber 5, when a quantity of steam is required greater than that generated by the water flowing through the orifice 35 controlled by the stem 37; the water is supplied to the pump 41, 45 by a suction duct 53 which extends down to the bottom of the tank 19. The elements of the other piston pump which are visible are: the cylinder 43, the suction duct 55 similar to the duct 53, the pushbutton 57 which is operated in the direction f57, and the delivery duct 59 for an external nozzle 61 which can be directed forwards and downwards so as to be able to project water onto the garment to be ironed, where this is required in addition to delivery of the steam supplied by the water flowing from the orifice 35 or from the duct 51.

63 denotes the electrical power supply obtained by means of a "flying cable" in accordance with well known arrangements.

Figure 6:
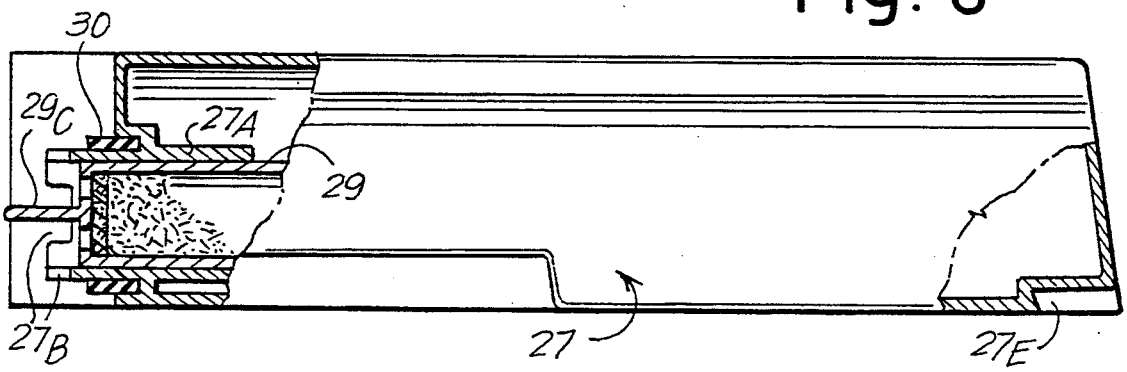
FIGS. 5 and 6 show a side view and partial section of the steam iron without container, and the container isolated and in partial section.
Figure 5:
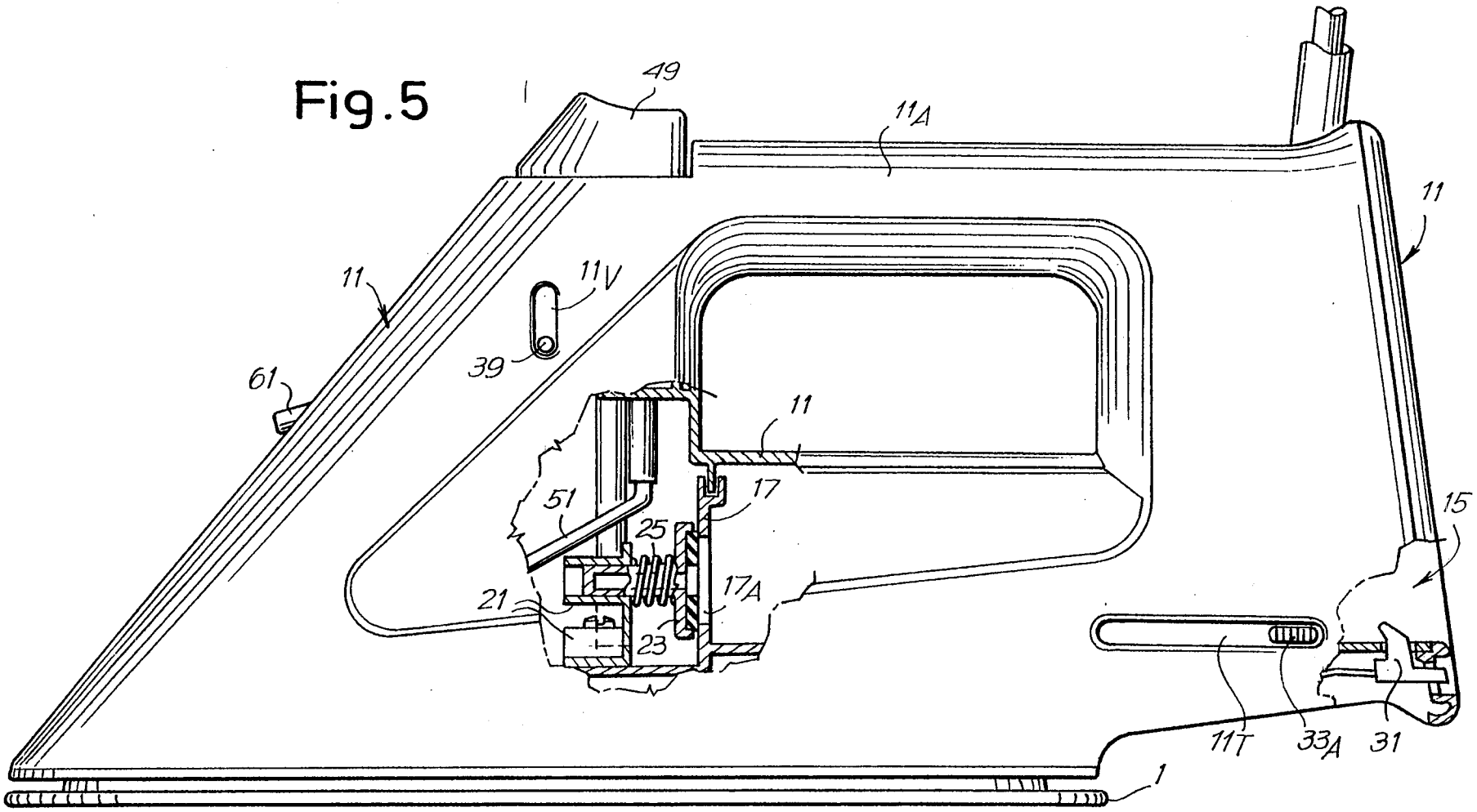

When the reservoir 27 is extracted (FIGS. 5 and 6) the hole 17A in the wall 17 is closed by the obturator 23 which is pressed by the spring 25, so that any water present in the tank 19 is unable to flow out from the hole 17A. The extracted reservoir (FIG. 6) can be easily filled with water by placing it in the vertical position and removing the cartridge 29 from the tubular mouth 27A with the aid of a lug 29C on the cartridge itself. After reintroducing the cartridge 29 (if this cartridge is required for correction of the water), the container 27 is reinserted into the seating 15 with automatic lowering of the tooth 31 until the latter clicks into the notch 27E for retaining the container itself inside the seating 15; when this condition is reached, the container 27 with its edge forming the recesses 27B passes beyond the hole 17A and pushes the obturator 23 against the action of the spring 25, lifting it from the wall 17 so as to reestablish communication between the container 27 and the tank 19.

The steam from the vaporization chamber 5 is emitted below the plate 1 via a series of holes 1F distributed in an arrangement which is conventional per se, the holes being suitably shaped for the requirements of ironing.

I claim:

1. An iron, comprising:

a plate; heating means for heating said plate, said plate and said heating means cooperating to form a vaporizer chamber; a tank for holding water to be supplied to said vaporizer chamber, said tank including a calibrated passage connecting said tank to said vaporizer chamber and a shaped stem for adjusting said calibrated passage to adjust an amount of water passing from said tank to said vaporizer chamber; a separate container defining a water reservoir including a tubular filling mouth for filling at a location spaced away from the iron; means defining a seating including walls within the iron extending longitudinally from said tank to a rear end of the iron and defining an opening at said rear end said means defining a seating including an end wall separating said seating from said tank, said end wall including a communication hole, said seating for receiving said container whereby said container is inserted into said seating and removed therefrom for filling, said tubular filling mouth penetrating into said hole to establish communication between said tank and said container upon said container being seated in said seating; obturator means position in side said tank biased elastically to close said hole, said obturator means being movable away from said hole by said tubular filling mouth upon insertion of said container into said seating; and an extractable cartridge containing demineralizing and filtering material, said tubular filler mouth of said container defining a seat for receiving said extractable cartridge.

2. The iron according to claim 1, wherein a seal is provided around said tubular filling mouth of said container, said seal cooperation with said end wall for sealing around said hole.

3. The iron according to claim 2, further comprising elastic tooth means positioned adjacent to said seating means for retaining said container in said seating and including a manual release element for releasing said container for extraction of said container from said seating.

4. The iron according to claim 1, further comprising elastic tooth means positioned adjacent to said seating means for retaining said container in said seating and including a manual release element for releasing said container for extraction of said container from said seating.

5. The iron according to claim 1, further comprising a casing engaged with said plate and a shell cooperating with said casing, said casing and said shell forming said tank and said means defining a seating.

6. The iron according to claim 5, wherein said shell forms cylinders with pumps operated by a push button for delivering additional water to said vaporizer chamber and providing water to be sprayed in front of the iron via a nozzle.

7. A steam iron, comprising:

a casing and a shell cooperating to define a steam iron housing, said casing and said shell forming a water tank in an interior region of said steam iron housing and said casing and said shell cooperating to define seating means with walls extending horizontally from said reservoir to an opening at a rear end of said steam iron housing and seating means including an end wall separating said seating means from said water tank, said end wall being provided with a communication hole providing the only filling opening to said water tank; a plate connected to said casing; heating means for heating said plate, said plate and said heating means cooperating to define a vaporizer chamber; a calibrated passage formed at a base of said water tank for providing communication between said tank and said vaporization chamber; a shaped stem positioned in said calibrated passage for adjusting water flow between said water tank and said vaporizer chamber; water container means for containing water and supplying water to said water tank, said water container means being independent and separate from said casing and said shell and including a tubular filling mouth for filling said container with water at a location spaced from said casing and shell said container being dimensioned to be inserted into said seating for supplying said tank with water and extracted therefrom for filling said container, said tubular filling mouth penetrating into said hole to establish communication between said tank and said container upon inserting said container into said seating; and an obturator positioned inside said tank adjacent to said hole; elastically biassing means for elastically biassing said obturator to close said hole, said obturator being movable away from said hole by said tubular filling mouth upon insertion of said container into said seating; locking means for locking said container in said seating tubular filling mouth penetrating into said hole with communication established between said tank and said container; and a demineralizing and filtering cartridge, said tubular filling mouth defining a seat for said demineralizing and filtering cartridge with said demineralizing and filtering cartridge being extractable and insertable into said tubular filling mouth seat.

8. An iron according to claim 7, further comprising a seal positioned around said tubular filling mouth of said container, said seal cooperating with said end wall to seal around said hole.

9. A steam iron, comprising:

a casing and a shell cooperating to define a steam iron housing with a handle bridging a front and rear end of the housing, said casing and said shell forming a water tank in an interior region of said steam iron housing and said casing and said shell cooperating to define seating means with walls extending horizontally from said reservoir to an opening at a rear end of said steam iron housing and seating means including an end wall separating said seating means from said water tank, said end wall being provided with a communication hole providing the only filling opening to said water tank; a plate connected to said casing; heating means for heating said plate, said plate and said heating means cooperating to define a vaporizer chamber; a calibrated passage formed at a base of said water tank for providing communication between said tank and said vaporization chamber; a shaped stem positioned in said calibrated passage for adjusting water flow between said water tank and said vaporizer chamber; removable water container means for containing water and supplying water to said water tank, said removable water container means being independent and separate from said casing and said shell and including a tubular filling mouth for filling said container with water at a location spaced from said casing and shell said container being dimensioned to be inserted horizontally, through said opening at a rear end of said steam iron housing into said seating for supplying said tank with water and extracted therefrom for filling said container, said tubular filling mouth penetrating into said hole to establish communication between said tank and said container upon inserting said container into said seating; an obturator positioned inside said tank adjacent to said hole; elastically biassing means for elastically biassing said obturator to close said hole, said obturator being movable away from said hole by said tubular filling mouth upon insertion of said container into said seating; a catch engageable with a detent formed in said water container for locking said water container in said seating with said tubular filling mouth penetrating into said hole with communication established between said tank and said container; and a demineralizing and filtering cartridge, said tubular filling mouth being of a size which is large enough to define a seat for said demineralizing and filtering cartridge with said demineralizing and filtering cartridge being extractable and insertable into said tubular filling mouth seat.

* * * * *